US006305027B2

(12) United States Patent
Chou

(10) Patent No.: US 6,305,027 B2
(45) Date of Patent: Oct. 23, 2001

(54) PANTS HAVING SPIRALLY ZIPPERED LEGS

(76) Inventor: Chao-Mu Chou, 4F, No. 14, Alley 11, Lane 123, Sec. 3, Jen Ai Road, Taipei (TW)

( * ) Notice: Subject to any disclaimer, the term of this patent is extended or adjusted under 35 U.S.C. 154(b) by 0 days.

(21) Appl. No.: 09/758,176

(22) Filed: Jan. 12, 2001

(51) Int. Cl.[7] ..... A41D 1/06
(52) U.S. Cl. ..... 2/227; 2/69
(58) Field of Search ..... 2/69, 69.5, 79, 2/234, 235, 80, DIG. 7, 83, 114, 227

(56) References Cited

U.S. PATENT DOCUMENTS 5,008,962 * 4/1991 Smith et al. ..... 2/234
5,033,126 * 7/1991 Wruck et al. ..... 2/242
5,822,802 * 10/1998 Chou ..... 2/227

* cited by examiner

*Primary Examiner*—Gloria Hale
(74) *Attorney, Agent, or Firm*—Dougherty & Troxell

(57) ABSTRACT

Pants with a spiral seam with a zipper provided from a torso part of pants extending downward to lower ends of the pants legs spirally around the respective pants leg and away from a front side of the knee.

8 Claims, 4 Drawing Sheets

PANTS HAVING SPIRALLY ZIPPERED LEGS

BACKGROUND OF THE INVENTION

1). Field of the Invention

The present invention relates to a pair of pants, and particularly to a pants on which a zipper is provided to surround each pants leg spirally downward and away from the front side of a knee part.

2). Description of Related Art

Clothes are greatly significant for us from the viewpoints of personal interest and symbol of social position in addition to an indication of different civilization. Strictly speaking, the function of clothes for covering the body has become less important in a developed economic society since other functions of clothes arose.

In fact, it is possible for clothes to provide special functions in certain situations such as casual suit, sports wear, patient suit, etc., which may be different from the traditional integral type and which may be opened locally for the need of these situations.

For instance, the present inventor has investigated the patient suit and owns many granted patents. U.S. Pat. No. 5,822,802 (equivalent to Taiwan Utility Model No. 106715) is a typical example. For the sports wear, pants for warming up body, which is available in the market, has provided the zipper for the zipping the clothes complying with the change of temperature.

Presently, it has not been seen that a pair of pants can be available for being partly opened or fully opened. Although the preceding sports pants can be opened for specific purposes, there are some disadvantages listed underneath:

(1) If a hook and loop fastener, buttons, or tying belt is used instead of zipper, clearances may generate to result in insufficient protection and privacy.

(2) While the zipper is used, the zipper is arranged to form a shape of straight line, i.e., a downward strip from top at exact front side or lateral side of the sports pants. Shortcomings are:

(a) When the sport is played, the stretching movement of the thigh against the zipper may cause discomfort and being without snugness in addition to influencing the movement.

(b) While the wearer is in a sprawl or a lateral position, discomfort may be caused because of the thigh pressing against and being stimulated by the zipper. Even worse, it is possible to cause the disease of decubitus.

(c) It is not possible for the zipper to be unfastened at any desired portion and the only way can be done is to unfasten the zipper from an end continuously.

SUMMARY OF THE INVENTION

An object of the present invention is to provide pants, which provide a seam with a zipper surrounding the respective pants leg in a way of spiraling downward from the pants torso part away from the knee part to enable the wearer to perform any specific purpose needed.

BRIEF DESCRIPTION OF THE DRAWINGS

The present invention can be more fully understood by referencing to the following description and accompanying drawings, in which.

DETAILED DESCRIPTION OF THE PREFERRED EMBODIMENT

Referring to FIGS. 1 to 4, the pants of present invention basically comprises a pants body 1 and a zipper 2 and the pants are not restricted for sports pants and patient pants.

The pants body 1 has two conventional pants legs 11 associated with a pants torso part 12 on top of the pants legs 11.

Figure 1:
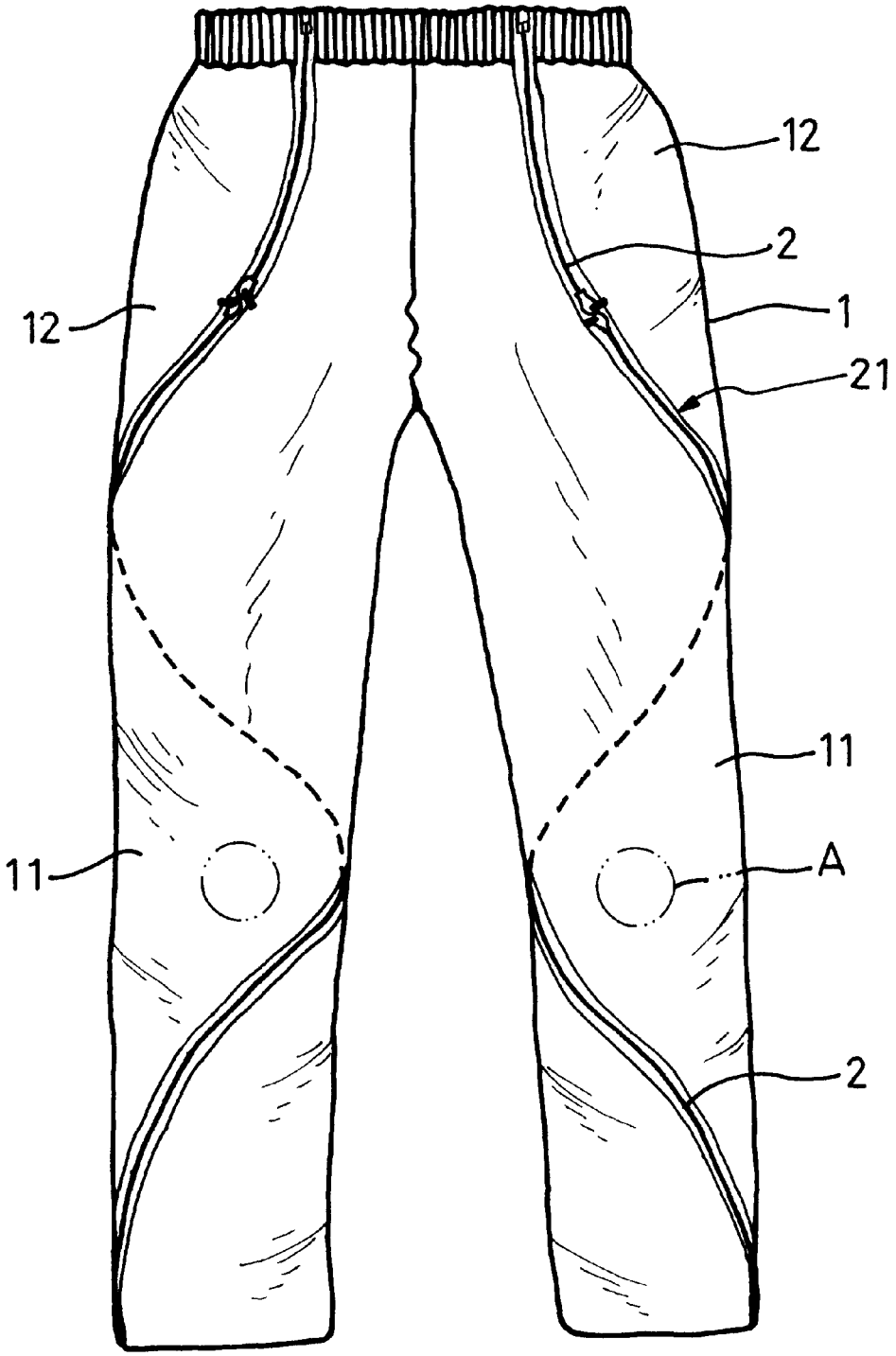
FIG. 1 is a plan view of a pair of pants according to the present invention in a first embodiment thereof.

As shown in FIG. 1, the difference between the pants of the present invention and the conventional pants is in that the left and the right pants legs 11 together with the pants torso part 12 has a separated seam 21 with a zipper 2 respectively. The seam 21 with the zipper 2 is provided to surround the respective pants leg 11 spirally in a way of extending downward from the pants torso part 12. The seam 21 at the knee part A is surrounded at the rear side thereof such that the knee may not reach the seam 21 and the zipper 2. In the first embodiment illustrated in FIG. 1, the seam 21 with the zipper 2 extends between the upper end of the pants torso part 12 at the front side thereof and the respective outer lateral side of the lower ends of the pants legs 11.

Figure 2:
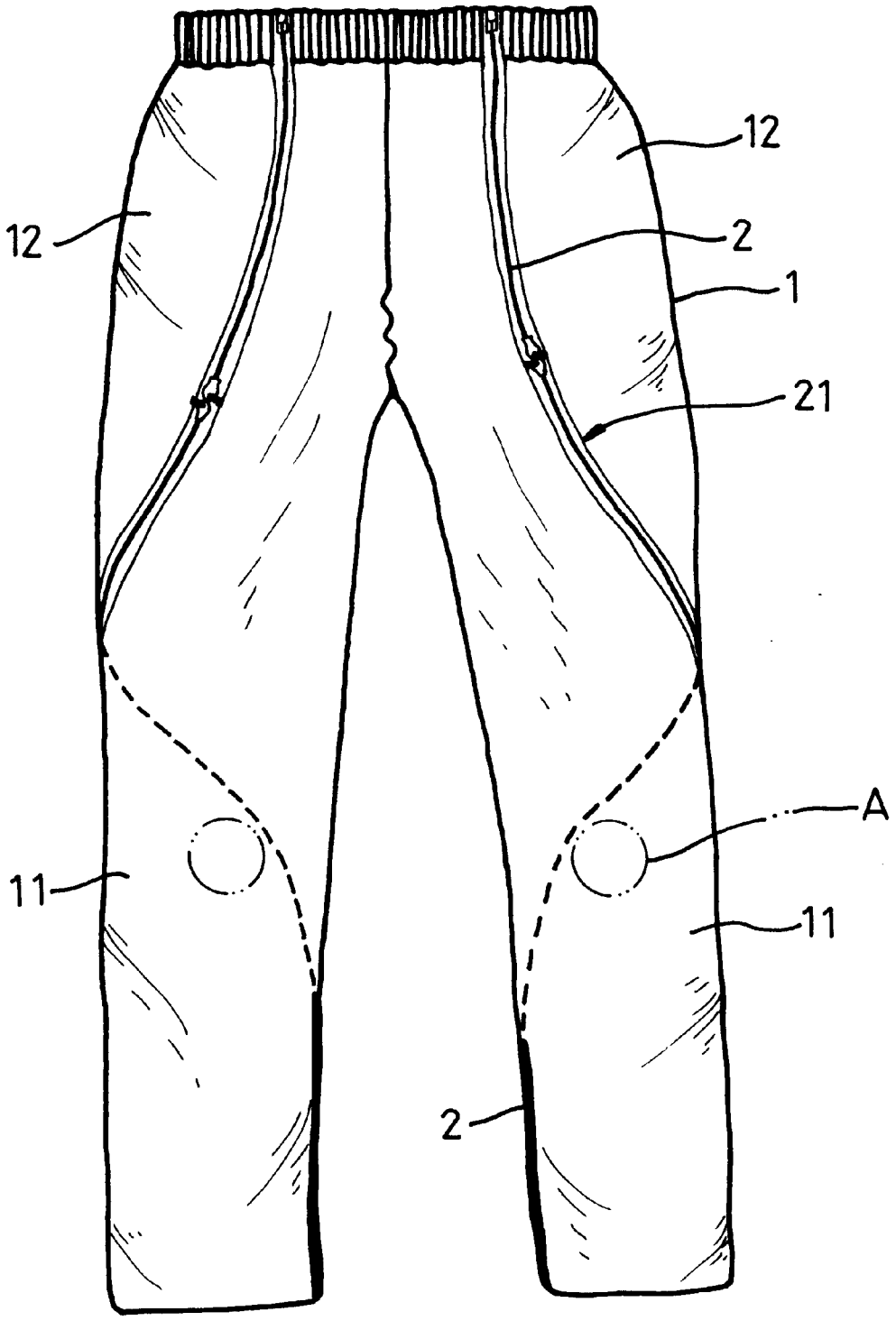
FIG. 2 is a plan view of a pair of pants according to the present invention in a second embodiment thereof.

Referring to FIG. 2, the second embodiment of the present invention is illustrated. The respective seam 21 with the zipper 2 extends between the upper end of the pants head at the front side thereof and the respective inner lateral side of the lower ends of the pants legs 11.

Figure 3:
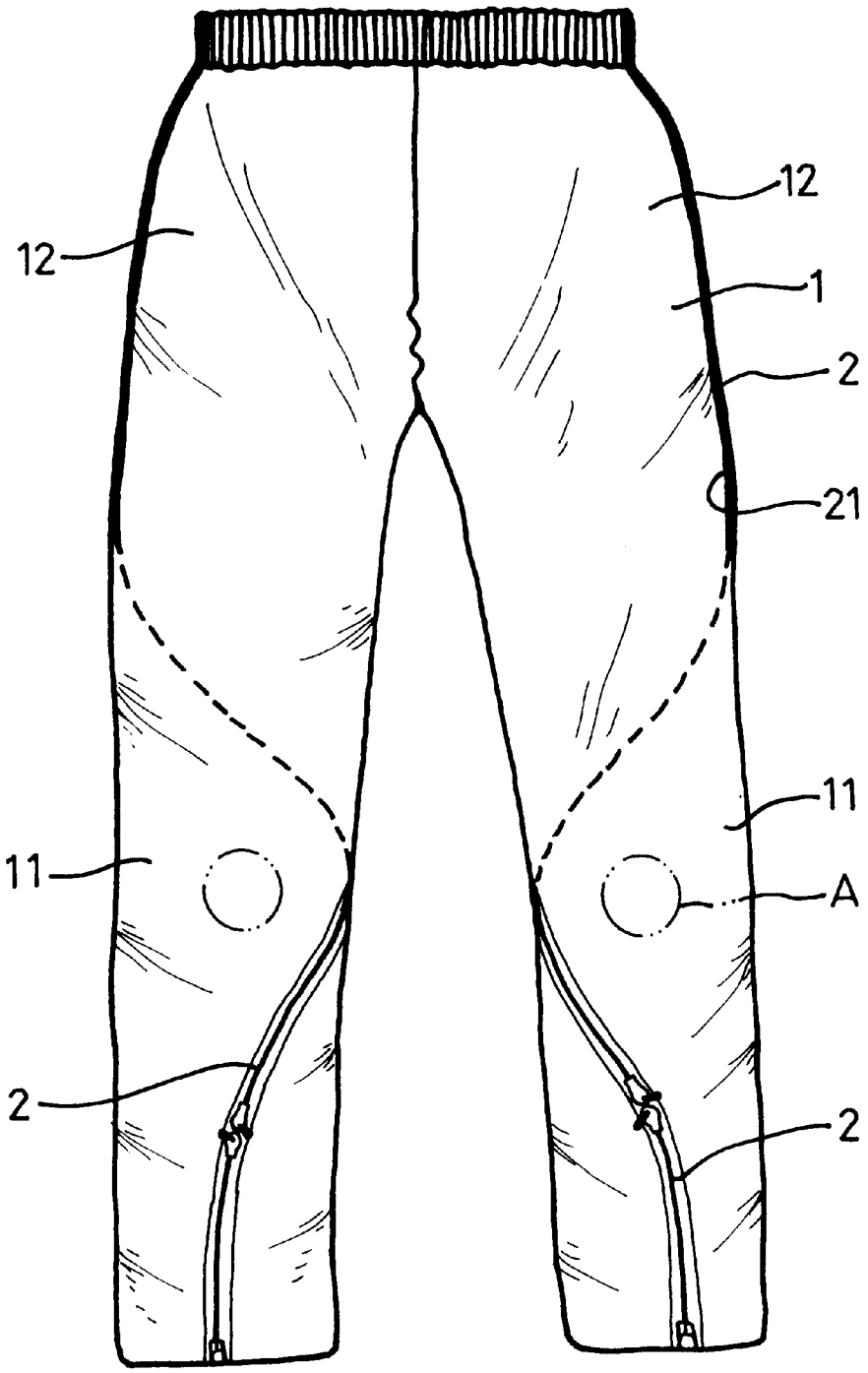
FIG. 3 is a plan view of a pair of pants according to the present invention in a third embodiment thereof.

Referring to FIG. 3, the third embodiment of the present invention is illustrated. The respective seam 21 with the zipper 2 extends between the upper end of the pants torso part 12 at each outer lateral side thereof and the respective front middle side of the lower ends of the pants legs 11.

Figure 4:
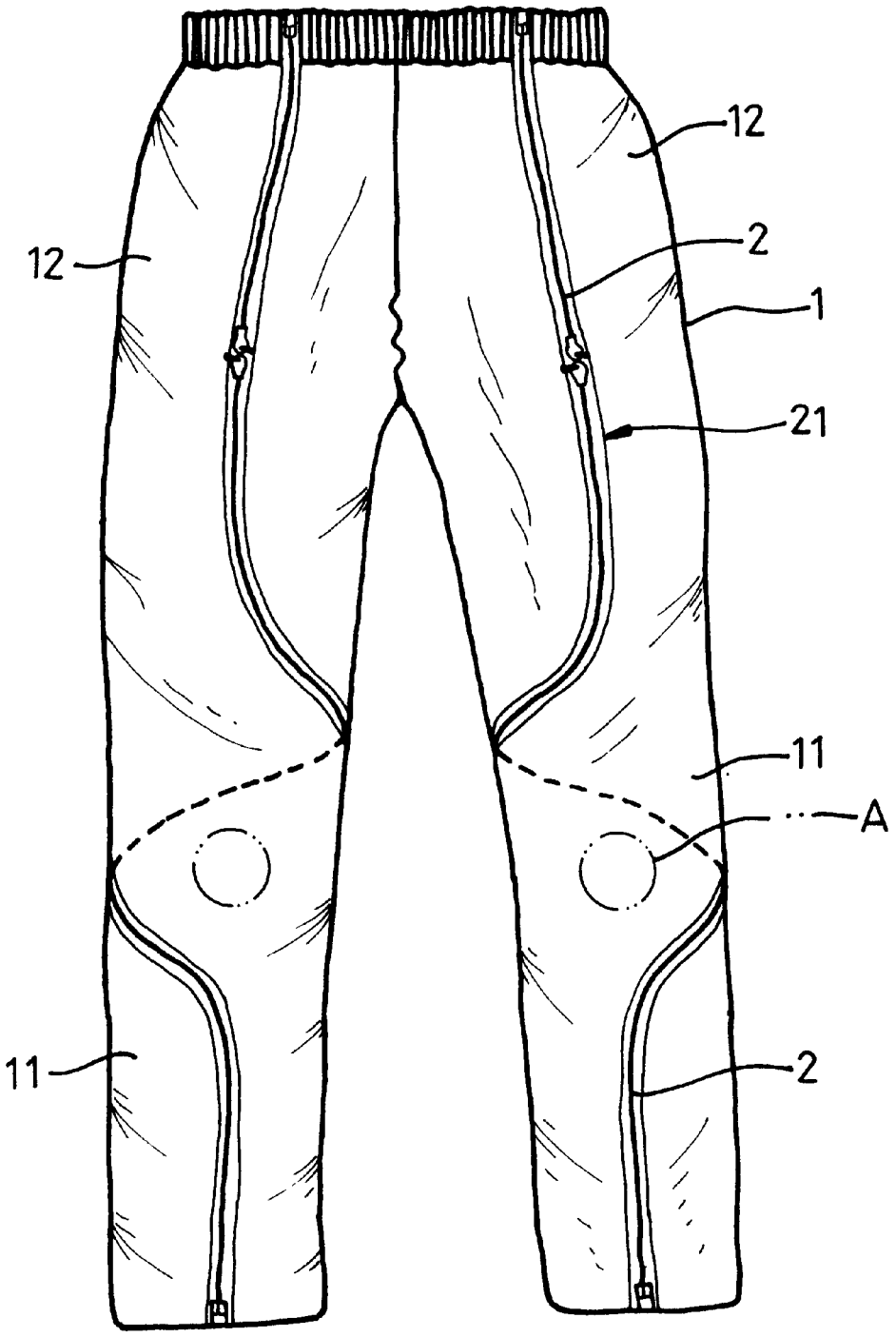
FIG. 4 is a plan view of a pair of pants according to the present invention in a fourth embodiment thereof.

Referring to FIG. 4, the fourth embodiment of the present invention is illustrated. The respective seam 21 with the zipper 2 extends between the upper end of the pants head 12 at the respective front side thereof and the respective front middle side of the lower ends on the pants legs 11.

It should be noted that many other arrangements and variations of the handy pants can be obtained in addition to the preceding four embodiments in order to reach the same effect. Accordingly, the present invention is not restricted by the preceding embodiments. Furthermore, the zipper 2 may be provided with a single zipper pull with two openings on a zipper tape or double zipper pulls with two openings on the zipper tape in order to achieve the function of the present invention.

It is appreciated that advantages of the present invention can be summarized in the following:

(1) The zipper is used for closing and opening the seam on the pants such that a tight engagement can be achieved.

(2) The zipper extends spirally and is away from the front side of knee part to be compatible with the movement of wearer's legs such that the wearer may feel and move comfortably.

(3) It results in a least contact with the zipper for postures of lying and sitting.

(4) The rear side of the pants can be worn as the front side instead and the surrounded zipper can be opened or closed at any place below the waist for the need of medical cure or temperature change.

While the invention has been described with reference to preferred embodiments thereof, it is to be understood that modifications or variations may be easily made without departing from the spirit of this invention, which is defined by the appended claims.

What is claimed is:

1. A pair of pants, comprising:

two pants legs, each of said two pants having a knee part;

a pants torso part with an upper end, being integral with said two pants legs; and, a seam with a zipper extending between the pants torso part and lower ends of each of the pants legs respectively each seam extending spirally around the respective pants leg away from a front side of the knee part.

2. The pair of pants according to claim 1, wherein said zipper has a single zipper pull with two openings on a zipper tape.

3. The pair of pants according to claim 1, wherein said zipper has double zipper pulls with two openings on a zipper tape.

4. The pair of pants according to claim 1, wherein said zipper extends from the upper end of the pants torso part at a front side thereof.

5. The pair of pants according to claim 1, wherein said zipper extends from the upper end of the pants torso part at a lateral side thereof.

6. The pair of pants according to claim 1, wherein the zipper has a lower end on a lower part of the respective pants leg at an outer lateral side thereof.

7. The pair of pants according to claim 1, wherein the zipper has a lower end on a lower part of the respective pants leg at an inner lateral side thereof.

8. The pair of pants according to claim 1, wherein the zipper has a lower end on a lower part of the respective pants leg at a front side thereof.

* * * * *